US006979475B2

(12) United States Patent
Dresser

(10) Patent No.: US 6,979,475 B2
(45) Date of Patent: Dec. 27, 2005

(54) PROCESS AND PRODUCT BY-PROCESS FOR STAINING A FIBERGLASS DOOR

(75) Inventor: Reid Dresser, Mooresville, NC (US)

(73) Assignee: Finishing Touch, Stain & Lacquer, LLC, Denver, NC (US)

( * ) Notice: Subject to any disclaimer, the term of this patent is extended or adjusted under 35 U.S.C. 154(b) by 206 days.

(21) Appl. No.: 10/372,592

(22) Filed: Feb. 21, 2003

(65) Prior Publication Data

US 2004/0166287 A1 Aug. 26, 2004

(51) Int. Cl.[7] ..... B05D 1/38; B05D 3/12

(52) U.S. Cl. ..... 427/258; 427/262; 427/264; 427/277; 427/358; 427/421.1; 427/429

(58) Field of Search ..... 427/258–287, 427/356, 358, 421, 429; 264/132, 137, 338

(56) References Cited

U.S. PATENT DOCUMENTS 3,847,646 A * 11/1974 Daunheimer et al. ..... 427/368
4,372,991 A * 2/1983 Kendall ..... 427/140
4,550,540 A * 11/1985 Thorn ..... 52/309.4
4,579,613 A 4/1986 Belanger
4,817,360 A 4/1989 Gorman
5,075,059 A 12/1991 Green
5,537,789 A 7/1996 Minke et al.
RE36,240 E 6/1999 Minke et al.
5,932,314 A 8/1999 West
5,934,040 A 8/1999 Chen
5,950,382 A 9/1999 Martino
5,989,681 A * 11/1999 Martino ..... 428/151
6,092,343 A 7/2000 West et al.
6,201,057 B1 * 3/2001 Porter ..... 524/501
6,226,958 B1 5/2001 West et al.

* cited by examiner

*Primary Examiner*—Fred J. Parker
(74) *Attorney, Agent, or Firm*—Dority & Manning, PA

(57) ABSTRACT

A pigmented fiberglass door and a process for finishing a molded, wood grain fiberglass door is provided. The pigmentation process comprises the sequential steps of priming the door surface; painting the door surface; staining the door surface while removing stain from raised grain edges of the door; and, applying a clear, protective coat to the door. This process has been found to provide a painted and/or stained door which has an appearance indistinguishable from a wooden door.

10 Claims, 2 Drawing Sheets

PROCESS AND PRODUCT BY-PROCESS FOR STAINING A FIBERGLASS DOOR

FIELD OF THE INVENTION

This invention is directed towards the manufacture of fiberglass doors. More particularly, the present invention is directed towards an improved process for staining or otherwise applying a coloring agent to a simulated, textured wood grain surface of the door that provides an improved appearance which more closely resembles a wooden door.

BACKGROUND OF THE INVENTION

This invention relates generally to fiberglass doors having a simulated, molded, wood grain texture. The formation of compression-molded doors from molding resins and reinforcing glass fibers is well known in the art. For instance, U.S. Pat. No. 4,550,540, assigned to Therma-Tru Corporation, and which is incorporated herein by reference, describes a process of providing compression molded doors. The door exterior surface has molded therein fine texture details designed to simulate the grain of a wood door.

It is also known in the art to provide compression-molded, pigmented doors having a simulated wood grain in which the pigmentation is applied to the fibers and molding composition during the door molding process. The pigmented door assemblies may be seen in reference to U.S. Pat. No. 5,932,314 assigned to Therma-Tru Corporation and which is incorporated herein by reference.

Other pigmented compression-molded doors are seen in reference to U.S. Pat. No. 5,934,040 to Chen and which is incorporated herein by reference. In the Chen patent, specific pigments are provided within the raw materials used to form the door surfaces. While such techniques are useful in providing a door having a uniform color, such pigmentation processes do not mimic the natural wood color and/or appearance of a real wood door.

A staining system for thermoset and thermoplastic doors is provided in U.S. Pat. No. 6,201,057 assigned to Therma-Tru Corporation and which is incorporated herein by reference. The process in the '057 patent applies a stain followed by a unique top coat of polyurethane having organopolysiloxane micro emulsions. As stated in the '057 patent, the desired top coat contains weatherability agents which bring about unexpected improvements in the durability of the polyurethane layer.

Frequently, fiberglass or other compression-molded, surface-textured doors are supplied with white pigmentation to facilitate consumers who may choose to paint a door. However, when solid color paints or stains are directly applied to fiberglass doors, the results are disappointing to many consumers. The resulting painted or stained door is unrealistic in appearance and the surface pigmentation is easily damaged.

Molded, textured doors are also provided having pigments added to the molding compounds so as to provide the resulting door exteriors with pigments which are selected to simulate a wood coloration. It is also known to apply wood stains or paints to compression-molded doors. However, the results do not approach the aesthetic look of a genuine, wood grain door. Further, it is difficult to maintain a consistent door appearance, particularly when using stains, from one manufacturing batch to another. As a result, retail outlets and consumers often receive door components which do not match accessories such as sidelights or, if replacement of a portion of a door assembly is required, the stained components may not match.

Despite advances and improvements within the art, there remains a need for a pigmentation process for a textured, molded door, such as a fiberglass door, which imparts a natural and realistic wood grain pigmentation to the door surface. Further, there remains a need in the art for a door pigmentation process which is compatible with a variety of conventional molded doors.

SUMMARY OF THE INVENTION

It is one aspect of at least one of the present embodiments to provide a process of applying pigments to a compression-molded thermoplastic or thermoset door in which the resulting pigmentation provides for a three-dimensional textured door surface which mimics the appearance of a real, wood grain door.

It is another aspect of at least one of the present embodiments of the invention to provide a process for applying coloring agents to a simulated, wood grain textured panel in which the applied coloring agent provides for a panel which mimics the appearance of real wood.

It is yet another aspect of at least one of the present embodiments of the invention to provide for a process for applying a weatherable pigmentation to a surface textured panel of fiberglass, thermoplastic, or a thermoset composite surface having minimal surface porosity in which the applied pigments result in a surface which has the aesthetic appearance of a wooden structure.

It is yet another aspect of at least one of the present embodiments of the invention to provide a process for imparting a realistic wood grain texture and pigmentation to a fiberglass door which can be maintained with a high degree of uniformity from one production lot to another.

These and other aspects of the present invention may be provided by a process of treating a molded non-porous article having a molded, three-dimensional wood grain to simulate a natural wood product comprising the sequential steps of: applying a primer coat to said article; applying a base coat of a paint to said primer coat; applying a stain to said base coat; removing a portion of the stain from an upper surface only of the three-dimensional wood grain; and, applying a protective top coat to said product.

The present invention also provides for a molded article having a structural wood grain surface, the wood grain surface comprising: a first coat of a primer, said primer in contact with said wood grain surface; a second coat of a paint applied to said first coat; a wood stain, applied to said second coat, said stain being present in recessed portions defined by said wood grain surface and being substantially absent from an uppermost raised portion of said wood grain surface; and, a top coat applied over said wood stain and said uppermost raised portion of said wood grain surface; wherein said molded article has an appearance of a pigmented, wood surface.

These and other features, aspects, and advantages of the present invention will become better understood with reference to the following description and appended claims.

BRIEF DESCRIPTION OF THE DRAWINGS

A fully and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

As provided for herein, the term "fiberglass door" is used to describe doors having fiber-reinforced, compression-molded door skins. While the examples described below are directed to fiberglass doors, the described process is believed applicable to other structures which have a simulated, textured or three-dimensional wood grain surface. Such molded structures may include door sidelights, non-wood paneling, planks, crown molding, window frames, and similar articles. Accordingly, the scope of the present invention is not limited to fiberglass doors and sidelights, but is applicable to other thermoplastic or thermoset composite, or compression-molded surfaces having a minimal surface porosity and which surface defines a simulated, structural wood grain. Additionally, the scope of the present invention may include pressed wood products, such as particle board, in which a textured, wood grain surface has been created using compression molding, a die-cut procedure, or similar process.

As provided for herein, the terms "pigment" and "pigmentation" are used to describe any substance that absorbs light. Such pigments may include stains, dyes, paints, and other coloring agents.

Figure 1:
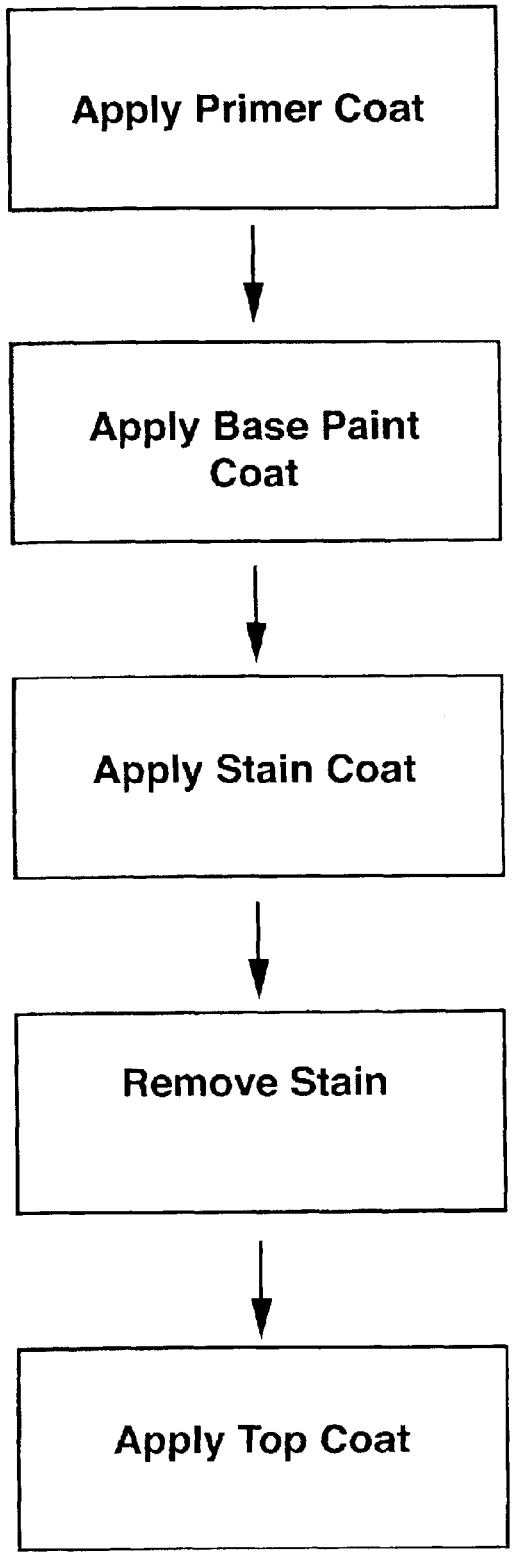
FIG. 1 is a flow chart setting forth the process steps in one preferred embodiment of the invention.

As seen in reference to FIG. 1, a process is described for applying surface pigments to a fiberglass door. The manufacture of suitable unfinished fiberglass door assemblies may be found in U.S. Pat. Nos. 4,550,540 and 5,537,789, both of which are incorporated herein by reference. The fiberglass door assemblies, in accordance with the present invention, are stained and/or painted by a process which results in a fiberglass door surface that more closely approximates a genuine, wood grain door than existing pigmentation and staining techniques. Additionally, the staining process provides for excellent control over the final wood grain appearance and color and achieves greater uniformity in color from one manufacturing lot to another.

EXAMPLE 1

A series of fiberglass test doors and sidelights were commercially obtained from Therma-Tru Corporation (Butler, Ind.) and Doorcraft Brand (Jeld-Wen, Inc., Klamath Falls, Oreg.). Additionally, imported fiberglass doors were commercially obtained from local building supply stores.

Step 1 (Optional)

The surface of the fiberglass door is preferably cleaned using soap and water or a chemical solvent such as alcohol, lacquer thinner, xylene, or a combination of the cleaners in one or more surface preparation steps. Preferably, a lint-free rag is used to clean the door surface. While not always necessary, the cleaning step helps remove manufacturing residue from the door's surface and thereby contributes to a better bond between the door and subsequent applications of primer.

Step 2

A conventional latex or oil-based primer is used to prime the simulated wood grain surface, as seen in reference to the steps shown in FIG. 1. The type of primer is not believed critical to the present invention. For exterior doors, the primer should be an exterior grade primer. The primer may be applied in a conventional manner and in accordance with the manufacturer's instructions. The primer may be applied using conventional techniques such as a roller, a brush, spraying, or other techniques known in the art. Following application of the primer, the door surface is allowed to dry.

Applicant has found that both latex and oil-based primers may be used according to this invention. Exterior grade latex primers include DTM brand and A-100 (Sherwin-Williams, Cleveland, Ohio). Suitable oil-based primers include Kemflash brand (Sherwin-Williams, Cleveland, Ohio), and XIM brand (XIM, Inc., Wellesley, Ohio). However, other brands of primers are believed useful in accordance with the present invention. Interior grade primers may be used for interior fiberglass doors.

Step 3

Following drying of the base primer coat, the door surface is painted with latex or oil-based paint. For exterior grade doors, an exterior latex or oil-based paint should be used. Two suitable paints include QuickDry and FastDry brands of oil enamel, both available from Sherwin-Williams. The paint may be applied in a conventional manner and dried in any fashion. The paint color may be selected from a wide variety of color choices and may be selected so as to provide good contrast and color combination in association with a subsequently applied stain. It has been found that a certain amount of routine experimentation is helpful in order to identify base coat colors which combine well, in an aesthetic sense, with subsequent stains. The door surface painting techniques may include any conventional paint application step including brushes, rollers, spray painting, sponging, or other paint application techniques known in the art. Following application of the base coat, the base coat is allowed to dry in accordance with the selected paint instructions and typically involves a minimum of 24 to 48 hours drying time under ambient conditions. Optionally, the base coat may be force dried.

Step 4

Following drying of the base paint coat, a pigment or coloring agent such as an exterior grade latex or oil-based wood stain like WOOD CLASSICS® oil-base stain (Sherwin-Williams, Cleveland, Ohio) (conventional wood stains) is applied to the painted door surface. Immediately following application of the stain, a blade, such as a rubber squeege, is applied across the surface of the door. The blade is preferably applied in a direction with the grain pattern of the simulated, wood-textured surface. However, where inset panels and door ornamentation so require, the blade may be applied across the grain.

The blade is used to remove a portion of the stain from the raised grain surfaces of the door. It is preferred that the blade comprise a resilient material which will not physically damage the door surface. Suitable blades include rubber, plastic, and rubber-covered metal blades. The blade surface should be sufficiently rigid so as to preferentially remove the wood stain from the raised grain surfaces without penetration of the blade into the recessed portion of the groove. A rubber squeege is useful in that the rubber blade has sufficient compression or "give" that the rubber blade surface will come in contact with a substantial number of the elevated ridges 14 (FIG. 2) even where a height of the elevated ridges 14 may differ across the surface of the door. As a result, stain present within the recessed regions defining the grain is largely unaffected by the application of the blade. The end result is that the door surface, following staining, has grain regions of more intense staining associated with the depressions and grooves of the grain. The uppermost portions of the raised surfaces of the grain, which are contacted by the blade surface, provide regions of less intense or minimal staining. The resulting contrast significantly enhances the aesthetic quality of the door's appearance. Following the staining step, the door is allowed to dry in accordance with the instructions and properties of the applied stain.

When using the above identified stain(s), it has been found useful to apply the blade across the door surface immediately following the application of the stain. However, it is envisioned that other brands of stains may have differences with respect to drying agents and drying times. As a result, there may be variation in the desired time interval between application of the stain and the passage of the squeege blade across the surface of the door. In addition, stains other than wood stains may be used including dyes, non-wood stains, and can include the application of paints. The preferred embodiment uses wood stains which have a consistency of water. The water-like consistency is believed important for the application and subsequent wiping, although other coloring agents including thinned or less viscous paints are believed also to be applicable to the present invention.

Step 5

Following the application and drying of the stain in step 4, a protective top coat is applied such as a clear polyurethane or varnish. The top coat may contain conventional additives such as UV protectors. Such additives are particularly desirable for exterior grade doors. It is preferable to apply multiple top coats so as to achieve a durable, protective layer. Suitable top coats include Sherwin-Williams brand exterior grade polyurethanes. One suitable water-based top coat includes VARATHANE® (Flecto Co., Inc. Hudson, N.C.) (conventional top coat), which provides for an exterior grade top coat.

The process as set forth in Example 1 provides for a resulting fiberglass door which more closely resembles a wooden door. By choosing appropriate color combinations of a base coat and an accompanying pigment such as a stain, one may provide a finish for the fiberglass door which provides a realistic appearance of a genuine, wooden stained door. Where a stained door appearance is not desired, other base coat colors may be used in combination with wood stains or other pigments which provides for a painted fiberglass door which more closely resembles the appearance of a painted wooden door.

The resulting pigmented door of the present invention avoids the uneven and inconsistent coloration that has been a problem with prior art doors. The combination of a base paint coat followed by a subsequent wood stain which is surface applied and then partially removed from a portion of the raised surfaces of the structural wood grain provides for an improved, realistic appearance. As a result, the stain is largely confined to the recessed portions of the simulated wood grain. Upon drying, the contrast between the stained recesses and the raised, painted, and substantially unstained portions of the wood grain provides for a painted door which resembles a genuine stained and/or painted wood door.

The process of the present invention offers several advantages in the finishing of simulated, structural wood grain structures such as fiberglass doors. Foremost, the structures can be manufactured without the added cost or complexity of applying pigments to the structure during the molding process. Additionally, the consistency of a subsequent base paint coat and wood stain coat is more easily controlled than direct pigmentation during manufacturing of the molded door components. As a result, a greater uniformity is possible from one series of doors to another. This latter feature is of enormous advantage to national retailers and distributors of pre-finished molded fiberglass doors. It is readily apparent to consumers on a side-by-side comparison that prior art fiberglass doors often have inconsistent finishes or have unacceptable differences in finish between the door and a sidelight accessory. The finishing process of the present invention can eliminate the unwanted color variation.

The present process also lends itself to applying a stain finish to a previously pigmented surface having a simulated, structural wood grain. In reference to a fiberglass door, it is known that fiberglass doors can be molded in a variety of stock colors. The appearance of such doors can be improved by applying a stain in combination with the previously described wiping step in which a portion of the applied stain is removed from the raised wood grain surfaces. Using the staining and wiping steps as described above to stain a previously pigmented door or other article having a molded structural wood grain, improves the aesthetic appearance of the resulting structural wood grain surface. The resulting structure has a wood grain appearance which more closely resembles a wooden surface.

Figure 2:
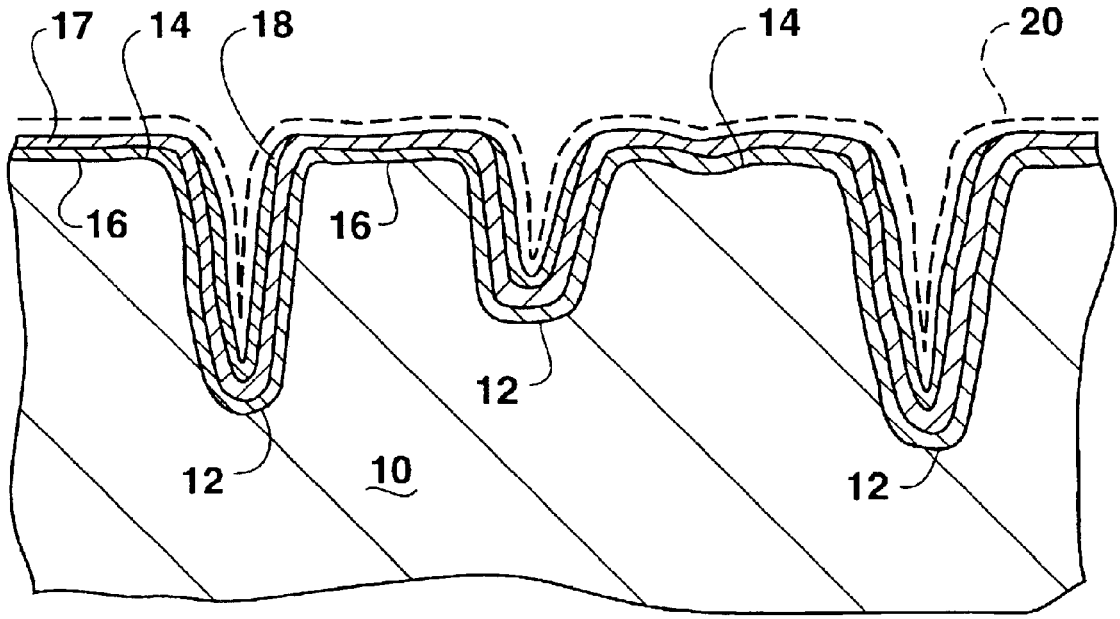
FIG. 2 is a cross section of one embodiment of an artificial structural wood grain surface setting forth various applied layers of the pigmentation process.

As seen in reference to FIG. 2, a cross section through a wood grain portion of a fiberglass door 10 is provided. As seen in reference to FIG. 2, an upper surface of door 10 defines a structural wood grain comprising a series of depressions 12 and elevated ridges 14. A primer coat 16 and a base paint coat 17 are shown applied as separate layers to the depressions 12 and elevated ridges 14 of the structural wood grain. While primer layers 16 and base coat 17 are shown as generally uniform layers, it is understood and appreciated by those having ordinary skill in the art that, depending upon the application techniques, a relatively thicker layer of primer 16 and/or paint layer 17 may occupy the depressions 12.

As further seen in reference to FIG. 2, a stain coat layer 18 is seen as largely restricted to the regions within depressions 12. As illustrated, the stain coat layer 18 is substantially absent from the upper surfaces of raised ridges 14 through the application of a wiping blade as described above. As best seen in reference to FIG. 2, the stain layer 18 is discontinuous across the wood grain surface, the stain 18 being largely confined to the recessed portions of the wood grain structure. In other words, stain 18 is substantially removed from the elevated ridges 14 by passage of the wiper blade during the stain application step. A clear top coat 20 provides a protective upper surface layer as provided for by dashed lines in FIG. 2. As discussed above, multiple top coat layers 20 may be provided.

The present process also lends itself to a staining kit having the necessary cleaning supplies, primer, paint, stain, and protective top coat along with the necessary brushes, rollers, wipers, and other accessories contained within one or more packages. In this manner, consumers and contractors can more easily choose from custom finishing kits so as to apply a desired pigmentation to a door. As such, neither the retailer nor the consumer are inconvenienced by a limited inventory of door colors. In addition, unfinished doors are more easily shipped and handled, since minor surface abrasions during handling will not affect the quality of the door when finished in accordance with the present invention.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A process of treating a molded non-porous article having a molded, three-dimensional wood grain surface having raised and recessed portions to simulate a natural wood product comprising the sequential steps of:

applying a primer coat to said article;

applying a base coat of a paint to said primer coat;

applying a stain to said base coat;

removing said stain from the raised portion of the three-dimensional wood grain surface such that said base coat is uncovered by said stain while retaining said stain in the recessed portions, to form a product; and, applying a protective top coat to said product.

2. The process according to claim 1 wherein said article is a door.

3. The process according to claim 2 wherein said door is a fiberglass door.

4. The process according to claim 3 wherein said base coat has a woodtone color.

5. The process according to claim 1 wherein said removing step additionally comprises passing a blade over the three-dimensional wood grain surface.

6. The process according to claim 5 wherein said blade is selected from the group consisting of rubber, plastic, rubber-coated metal blades, and plastic-coated metal blades.

7. The process according to claim 1 wherein said step of removing a portion of the stain additionally includes selectively removing wood stain from an elevated portion of said upper surface of the three-dimensional wood grain.

8. The process according to claim 1 wherein one or more of said applying steps may be selected from the steps consisting of spraying, brushing, rollering, wiping, sponging, or a combination thereof.

9. A process of treating a molded article having a simulated structural wood grain surface having raised and recessed portions comprising:

applying a stain to a molded article having a simulated, structural wood grain surface; and, removing said stain from raised surfaces defined by said simulated structural wood grain surface such that said simulated structural wood grain surface is uncovered by said stain while retaining said stain in the recessed portions.

10. The process according to claim 9 wherein said step of removing a portion of said stain additionally includes passing a blade across said wood grain surface.

* * * * *